United States Patent [19]

Mefferd

[11] 4,299,144

[45] Nov. 10, 1981

[54] HAND TOOL AND METHOD FOR USING SAME

[76] Inventor: Roy J. Mefferd, 219 W. Myrtle St., Laurens, Iowa 50554

[21] Appl. No.: 131,701

[22] Filed: Mar. 19, 1980

[51] Int. Cl.[3] ..... B25B 19/00; B25B 27/00

[52] U.S. Cl. ..... 81/3 R; 29/275; 81/463

[58] Field of Search ..... 29/275; 81/3 R, 463, 81/465, 90 C

[56] References Cited

U.S. PATENT DOCUMENTS

| | | | |
|---|---|---|---|
| 1,333,286 | 3/1920 | Smith | 29/275 X |
| 1,941,565 | 1/1934 | Mandl | 29/275 |
| 2,744,431 | 5/1956 | Scime | 29/275 X |
| 3,596,539 | 8/1971 | Gollaher | 81/3 R |
| 3,783,492 | 1/1974 | Duckett et al. | 29/275 X |
| 4,188,701 | 2/1980 | Ludwig | 29/275 |

OTHER PUBLICATIONS

Western Electric "Technical Digest No. 57", Impact Spanner Wrench, Oct. 1979, C. B. Begg.

*Primary Examiner*—James G. Smith

*Attorney, Agent, or Firm*—Zarley, McKee, Thomte, Voorhees & Sease

[57] ABSTRACT

The hand tool of the present invention is utilized for rotating a nut threadably mounted on a bolt or shaft, the nut having a pin receiving hole located radially outwardly from its axis. The tool comprises an elongated handle portion having a blunt radius end for receiving blows from a hammer and having a second end opposite from the blunt end. The second end includes at least one pin adapted to matingly fit within the hole in the nut. The nut can be turned by inserting the pin within the hole and by striking the blunt end of the tool handle so as to impart a rotational force to the nut.

6 Claims, 9 Drawing Figures

HAND TOOL AND METHOD FOR USING SAME

BACKGROUND OF THE INVENTION

The present invention relates to a hand tool for rotating a nut and a method for using the hand tool.

Many types of equipment utilize nuts which are either round or are too large for receiving conventional wrenches. These nuts usually include around their outer periphery, a plurality of pin receiving holes or milled slots adapted to receive the pins or legs of a spanner wrench for rotating the nut.

The problem encountered with using spanner wrenches for these types of nuts is that a different sized spanner wrench is required for each size of nut. Furthermore, some nuts include the pin receiving holes or slots on the upper axial end of the nut, whereas other types of nuts include the holes or slots on the cylindrical circumference of the nut. Different types of spanner wrenches must be used for each of these two types of nuts.

Because such a wide variety of sizes and shapes of spanner wrenches are required for these nuts, most machinists do not have or cannot locate the spanner wrench of the right size at the time it is needed. Consequently, the common practice is to insert a punch into one of the pin receiving holes or slots at an angle and to strike the punch with a hammer so as to rotate the nut. This results in gouging and deformation of the pin receiving holes or slots in the nut. After such a process has been used numerous times, the nut often becomes so deformed that it is rendered useless.

Therefore, a primary object of the present invention is the provision of an improved hand tool for rotating nuts, and an improved method for utilizing the hand tool.

A further object of the present invention is the provision of a hand tool which can be adapted to numerous different sizes of nuts and also to nuts of different configurations.

A further object of the present invention is the provision of a hand tool which can be inserted into the pin receiving hole or slot of the nut and which fits snugly therein so as to minimize the tendency to deform the nut adjacent to the pin receiving hole or slot.

A further object of the present invention is the provision of a hand tool which includes a pin at one end thereof for inserting into the pin receiving hole or slot of the nut, and which includes a handle which angles upwardly from the pin so that the distal end of the handle is spaced upwardly from the upper surface of the nut.

A further object of the present invention is the provision of a hand tool which is economical to manufacture, durable in use and efficient in operation.

SUMMARY OF THE INVENTION

The hand tool of the present invention includes a handle portion having a blunt radiused end at one end for receiving a hammer and at least one pin at the other end for inserting into the pin receiving hole or slot of the nut. Adjacent the pin is a shank portion which is tapered slightly with respect to the handle portion. The shank portion has a surface which is approximately perpendicular to the longitudinal axis of the pin so that when the pin is inserted within the pin receiving hole or slot, the shank portion rests snugly against the upper surface of the nut. The angle between the shank portion and the handle portion permits the distal end of the handle to be elevated slightly above the surface of the nut so as to be free and clear for being struck by a hammer.

The longitudinal axis of the pin is slightly out of perpendicular with the longitudinal axis of the handle, and this also contributes to the elevation of the distal end of the handle when the pin is within the pin receiving hole or slot of the nut.

More than one pin may be provided on the end of the tool, each pin being of a slightly different size and cross-sectional configuration. If two pins are included on the end of each tool, a set of perhaps five or six tools will accommodate most, if not all, of the various sizes and shapes of pin receiving holes or slots found in nuts. Thus, a set of five or six tools of the present invention will provide a mechanic with all of the various sizes and shapes he needs, whereas dozens and dozens of different sized spanner wrenches would be required.

DETAILED DESCRIPTION OF THE DRAWINGS

Figure 1:
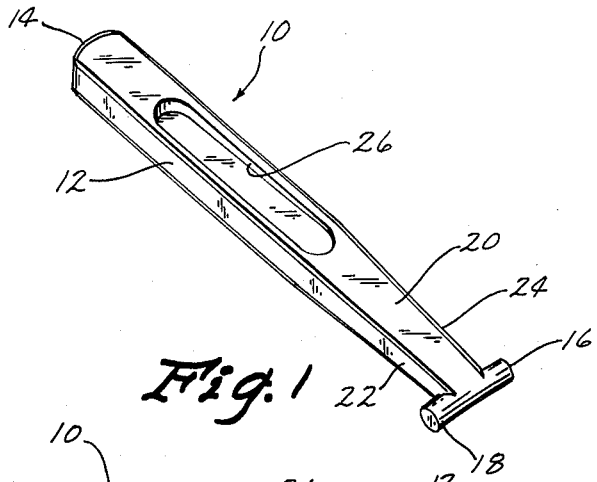
FIG. 1 is a perspective view of the tool of the present invention.
Figure 2:
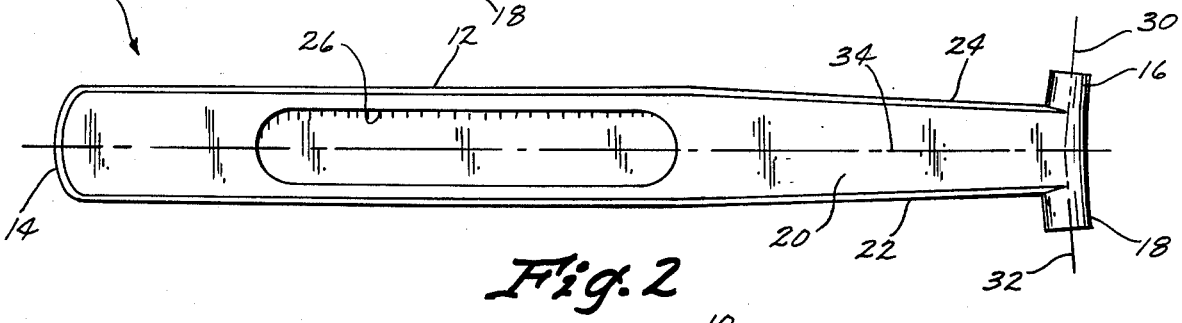
FIG. 2 is a plan view of the tool shown in FIG. 1.
Figure 3:
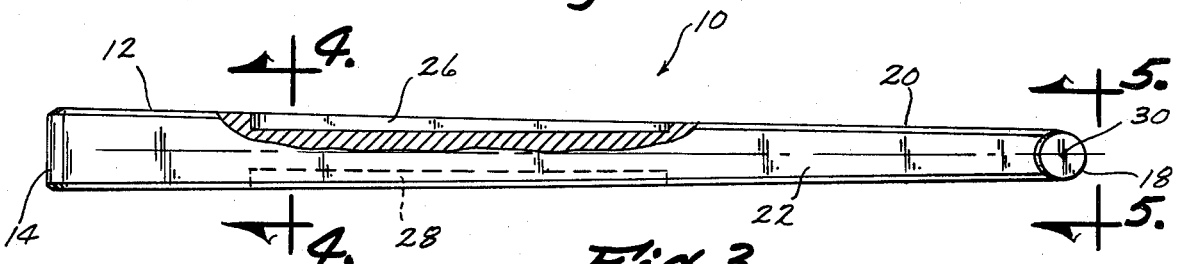
FIG. 3 is a front elevational view of the tool shown in FIG. 2, with a portion thereof being shown in section.
Figure 4:
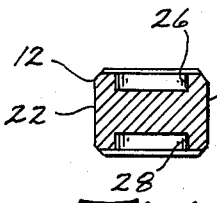
FIG. 4 is a sectional view taken along line 4—4 of FIG. 3.
Figure 5:
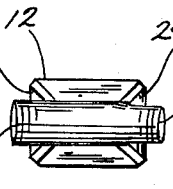
FIG. 5 is an end view taken along line 5—5 of FIG. 3.

Referring to the drawings, the numeral 10 refers to the hand tool of the present invention. Tool 10 includes a handle 12 having a blunt radiused end 14 at one end and having a pair of pins 16, 18 mounted at the other end. Adjacent pins 16 and 18 is a shank portion 20 having a shank surfaces 22, 24 thereon. A pair of hollowed-out portions 22, 24 are also provided in handle 12 for the purposes of lightening the tool and offering a better grip on the tool.

It should be noted that pin 16 is of slightly smaller diameter than pin 18, and also the longitudinal pin axes 30, 32 are disclosed at an angle slightly out of perpendicular with the longitudinal handle axis 34. Furthermore, surfaces 22, 24 are approximately perpendicular to longitudinal pin axes 30, 32, respectively.

Figure 9:
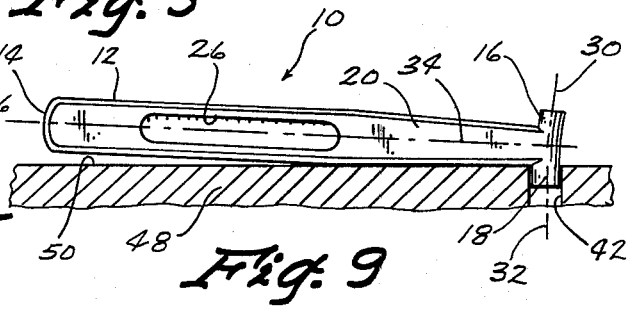
FIG. 9 is an elevational view showing the use of the tool and its position with respect to the upper axial surface of the nut.
Figure 6:
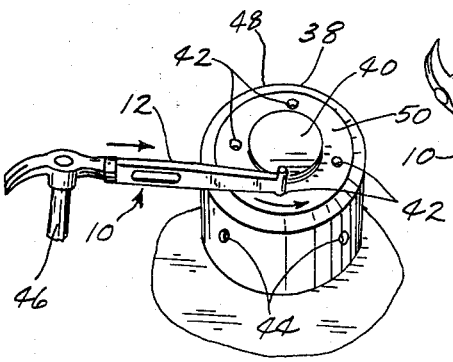
FIG. 6 is a perspective view of the use of the tool on the upper axial surface of a nut.
Figure 7:
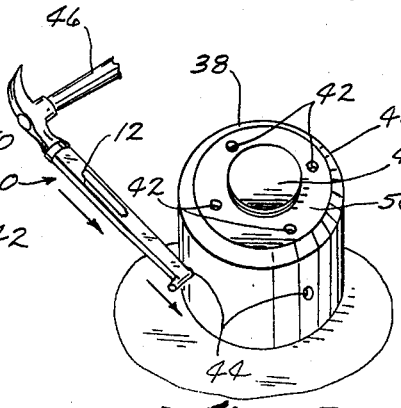
FIG. 7 is a perspective view showing the use of the hand tool on the cylindrical surface of the nut.

Referring to FIGS. 6, 7 and 9, tool 10 is used in the following manner. A nut 38 is shown threaded over a bolt or shaft 40. Nut 38 includes on its upper cylindrical surface a plurality of pin receiving holes or slots 42. For illustration purposes, nut 38 is shown also to have a plurality of circumferential holes and slots 44 around its cylindrical sides. Normally a nut would have either holes or slots 42 or holes or slots 44, but in most cases the nut would not include both types of holes or slots.

Both types are shown in the drawing primarily for illustrative purposes.

FIG. 6 illustrates the use of the tool with one of the pins inserted within one of the holes 42 on the axial end of the nut. The hammer 46 is used to strike the blunt end 14 of the tool thereby imparting a rotational force to the nut. Because the pins 30, 32 are of slightly different size, it is possible to match the proper sized pin with the hole or slot 42 so that there is a snug fit.

Referring to FIG. 9, tool 10 is shown in use with a very large nut 48. With such large nuts, it is desirable to elevate the blunt end 14 of handle 12 above the upper surface 50 of nut 48 so that the blunt end 14 is free for striking by a hammer without binding or being in close proximity to the upper surface 50. This is accomplished by means of the angular disposition of the longitudinal axis 30, 32 of pins 16, 18 with respect to the longitudinal axis 34 of handle 12. It should be noted that shank surface 22, being perpendicular to the longitudinal axis 32 of pin 18, fits snugly against the upper surface 50 of nut 48 so as to insure a solid mating connection between pin 18 and hole 42 in nut 48. This snug fitting arrangement is important to the present invention inasmuch as it minimizes the play between pin 18 and the margins of hole 42, thereby minimizing the gouging and deformation of the margins of the hole, as has previously occurred with prior devices.

Referring to FIG. 7, tool 10 is shown in use with holes 44 around the circumference of nut 38. Pin 18 is inserted within hole 44 up to the point where surface 22 comes in engagement with the outer cylindrical surface of nut 38. Tapping of the radiused blunt end of the handle causes rotation of the nut without deforming or gouging the pin holes 44. The radius of blunt end 14 is chosen so as to cause the force of the blow from the hammer to be directed down the longitudinal axis 34 of handle 12. This direction of force down centerline 34 occurs even when the blow from the hammer is slightly out of line with centerline 34. Without a radius on blunt end 14, the hammer would rebound erratically unless it struck perfectly true with respect to centerline 34.

Figure 8:
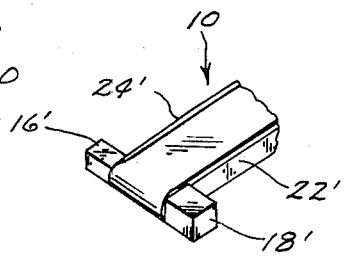
FIG. 8 is a partial perspective view of a modified form of pin which can be incorporated onto the end of the hand tool that is used on slotted type nuts.

FIG. 8 illustrates a modified form of tool 10 showing shank surfaces 22', 24' and showing square or rectangular pins 18' and 16'. This type of tool can be used to accommodate nuts having pin receiving slots which are rectangular in configuration.

The tool of the present invention, though simple, greatly improves the ability of mechanics and machinists to work with nuts having the pin receiving holes or slots such as shown in FIGS. 6, 7 and 9. The tool does not gouge the margins of the holes, and permits the application of considerable force to the nut to remove it from its threaded engagement around shaft 40.

The tool is easily adapted to be utilized in a small set of tools, each having pins of slightly different sizes or configurations. A set of five to ten tools can accommodate the various sizes and shapes of holes or slots in most nuts. In contrast, the spanner wrenches which are presently used must have a different size and shape of pin for each different hole or slot, and must also have a different size wrench for each size nut, thereby increasing manyfold the number of wrenches which are required in order to provide for various sizes and shapes of nuts.

The tool of the present invention is superior to the prior conventional method of inserting a punch into the pin receiving holes because the tool of the present invention does not gouge or deform the margins of the pin receiving holes or slots. Thus, it can be seen that the device accomplishes at least all of its stated objectives.

What is claimed is:

1. A hand tool for rotating a nut threadably mounted on a shaft, said nut being rotatable about a first axis to alternatively loosen and tighten its threaded connection to said shaft, said nut having at least one hole therein of a predetermined shape and size, said hole being located radially outwardly from said first axis whereby application of a tangential force to said nut at said hole will create a rotational force to said nut about said first axis; said hand tool comprising:

an elongated handle portion having a blunt end for receiving blows from a hammer, and a second end opposite from said blunt end for engaging said nut, said second end comprising at least one pin of predetermined size and shape which corresponds to the size and shape of said hole whereby said pin will matingly fit within said hole, said handle portion having a longitudinal handle axis and said pin having a longitudinal pin axis which extends laterally away from said handle axis whereby a hammer blow applied to said blunt end of said handle will apply a rotational force to said nut about said first axis whenever said pin is within said hole, said handle portion comprising a shank portion adjacent said pin, said shank portion having a shank surface for engaging the surface of said nut adjacent said hole whenever said pin is within said hole, said shank surface and the longitudinal axis of said pin being approximately perpendicular to one another whereby said shank surface will fit in facing engagement with said adjacent surface of said nut when said pin is within said hole.

2. A hand tool according to claim 1 wherein said second end of said handle comprises two pins, each extending in different directions and each having a different cross-sectional size for accommodating sized holes in said nut.

3. A hand tool according to claim 1 wherein said handle axis and said pin axis are disposed at an angle greater than 90° with respect to one another whereby said handle axis will angle upwardly and away from said surface of said nut when said pin is inserted within said nut.

4. A hand tool according to claim 3 wherein said pin has a rectangular cross sectional configuration.

5. A hand tool according to claim 3 wherein said pin has a circular cross sectional configuration.

6. A method for using a hand tool to turn a nut threaded on a shaft, said nut having at least one hole located radially outwardly from the rotational axis of said nut, said tool comprising a handle portion having a blunt end for receiving blows from a hammer and a second end opposite from said blunt end for engaging said nut, at least one pin on said second end being sized and shaped to matingly fit within said one hole, the longitudinal axis of said pin extending laterally away from the longitudinal axis of said handle portion, said method comprising:

inserting said pin into said hole in said nut, so that said pin matingly fits therein;

aligning the longitudinal axis of said handle portion in a direction approximately transverse to a radius of said nut passing through said hole, striking said blunt end of said handle portion so as to impart an impelling force along said longitudinal axis of said handle portion whereby said force will be transmitted through said pin to said nut to cause rotation of said nut about said bolt, engaging the surface of said nut adjacent said one hole thereof with a shank surface of said handle portion adjacent said one pin, said shank surface and the longitudinal axis of said one pin being approximately perpendicular to one another whereby said shank surface will fit in facing engagement with said adjacent surface of said nut when said pin is within said one hole.

* * * * *